US006684533B1

(12) United States Patent
Su

(10) Patent No.: US 6,684,533 B1
(45) Date of Patent: Feb. 3, 2004

(54) PIVOTAL BACK FOR A SANDAL STYLE SHOE

(76) Inventor: Cheng-Wen Su, No. 105-3, An-Hsi Chuang, An-Hsi Li, Changhwa Hsien (TW)

( * ) Notice: Subject to any disclaimer, the term of this patent is extended or adjusted under 35 U.S.C. 154(b) by 0 days.

(21) Appl. No.: 10/300,362

(22) Filed: Nov. 20, 2002

(51) Int. Cl.[7] ..... A43B 21/00
(52) U.S. Cl. ..... 36/105; 36/11.5
(58) Field of Search ..... 36/105, 11.5, 138, 36/50.1, 50.5

(56) References Cited

U.S. PATENT DOCUMENTS 2,452,649 A * 11/1948 Graves ..... 36/138
3,146,535 A * 9/1964 Owings ..... 36/138
3,192,651 A * 7/1965 Smith ..... 36/105
5,127,170 A * 7/1992 Messina ..... 36/105
5,184,410 A * 2/1993 Hamilton ..... 36/105
5,282,327 A * 2/1994 Ogle ..... 36/138
5,481,814 A * 1/1996 Spencer ..... 36/138
6,594,921 B2 * 7/2003 Laio et al. ..... 36/138

FOREIGN PATENT DOCUMENTS

WO 92/03943 * 3/1992

* cited by examiner

*Primary Examiner*—Ted Kavanaugh
(74) *Attorney, Agent, or Firm*—Dellett & Walters

(57) ABSTRACT

A pivotal back for a sandal style shoe with a sole is adapted to be pivotally attached to the sole (41). The pivotal back is composed of a back (10), a pivot device attached to the back (10) and a hinge (30) attached to the sole (41) to support the pivot device. The back (10) can be pivoted out from the sandal style shoe to release constraints on a foot so a person wearing the sandal style shoe can conveniently put on or take off the sandal style shoe.

8 Claims, 6 Drawing Sheets

PIVOTAL BACK FOR A SANDAL STYLE SHOE

BACKGROUND OF THE INVENTION

1. Field of the Invention

The present invention relates to a back for a shoe, and more particularly to a pivotal back for a sandal style shoe to make the sandal style shoe convenient to wear.

2. Description of Related Art

A conventional sandal style shoe with a back usually has at least one strap attached to the back to securely hold the sandal on a user's foot. A fastening device is attached to the at least one strap to release or secure the sandal style shoe.

One fastening devices used is a buckle composed of a frame and a tongue attached to a first strap. Multiple holes are defined in line on a second strap to selectively hold the tongue and attach the second strap to the buckle. When the user wears the sandal style shoe, the second strap must passes through one side of the frame and the tongue is selectively inserted into a desired hole. Then, the second strap passes through the other side of the frame to fasten the buckle, and the sandal style shoe is firmly mounted on the user's foot. However, wearing a sandal style shoe having a buckle is troublesome and wastes time, even when taking the sandal style shoe off.

Another fastening device is VELCRO composed of two different nylon fabrics detachably connecting to each other. The two nylon fabrics are secured on a first strap and a second strap respectively and are disengaged easily by pulling them apart. Therefore, the straps are engaged or disengaged conveniently when VELCRO is used as the fastening device. However, the straps having no elasticity cannot be adjusted because the two nylon fabrics of the VELCRO are always attached to set positions relative to each other. Moreover, the VELCRO easily loses its ability to hold securely when the two nylon fabric are separated many times and wore out.

To overcome the shortcomings, the present invention provides a pivotal back for a sandal style shoe to mitigate and obviate the aforementioned problems.

SUMMARY OF THE INVENTION

The main objective of the invention is to provide a pivotal back for a sandal style shoe to make the sandal style shoe convenient to put on or remove.

Objectives, advantages and novel features of the invention will become more apparent from the following detailed description when taken in conjunction with the accompanying drawings.

DETAILED DESCRIPTION OF PREFERRED EMBODIMENT

Figure 1:
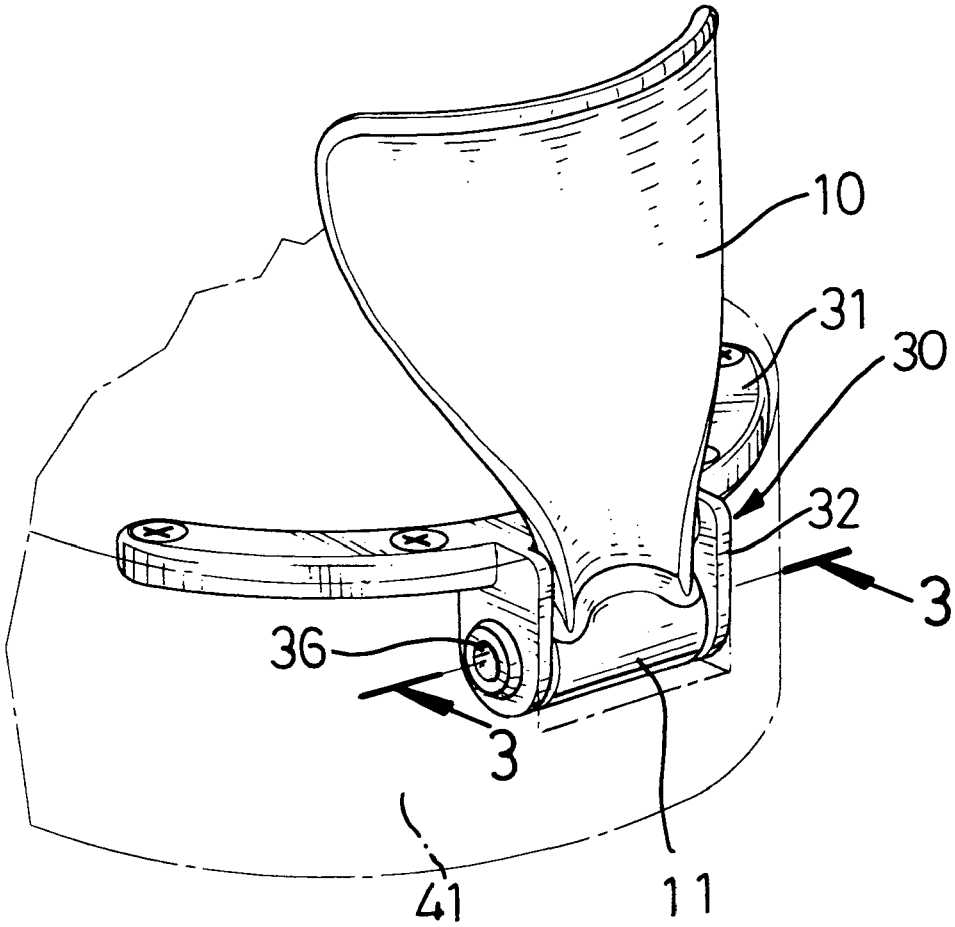
FIG. 1 is a perspective view of a pivotal back for a sandal style shoe in accordance with the present invention.
Figure 2:
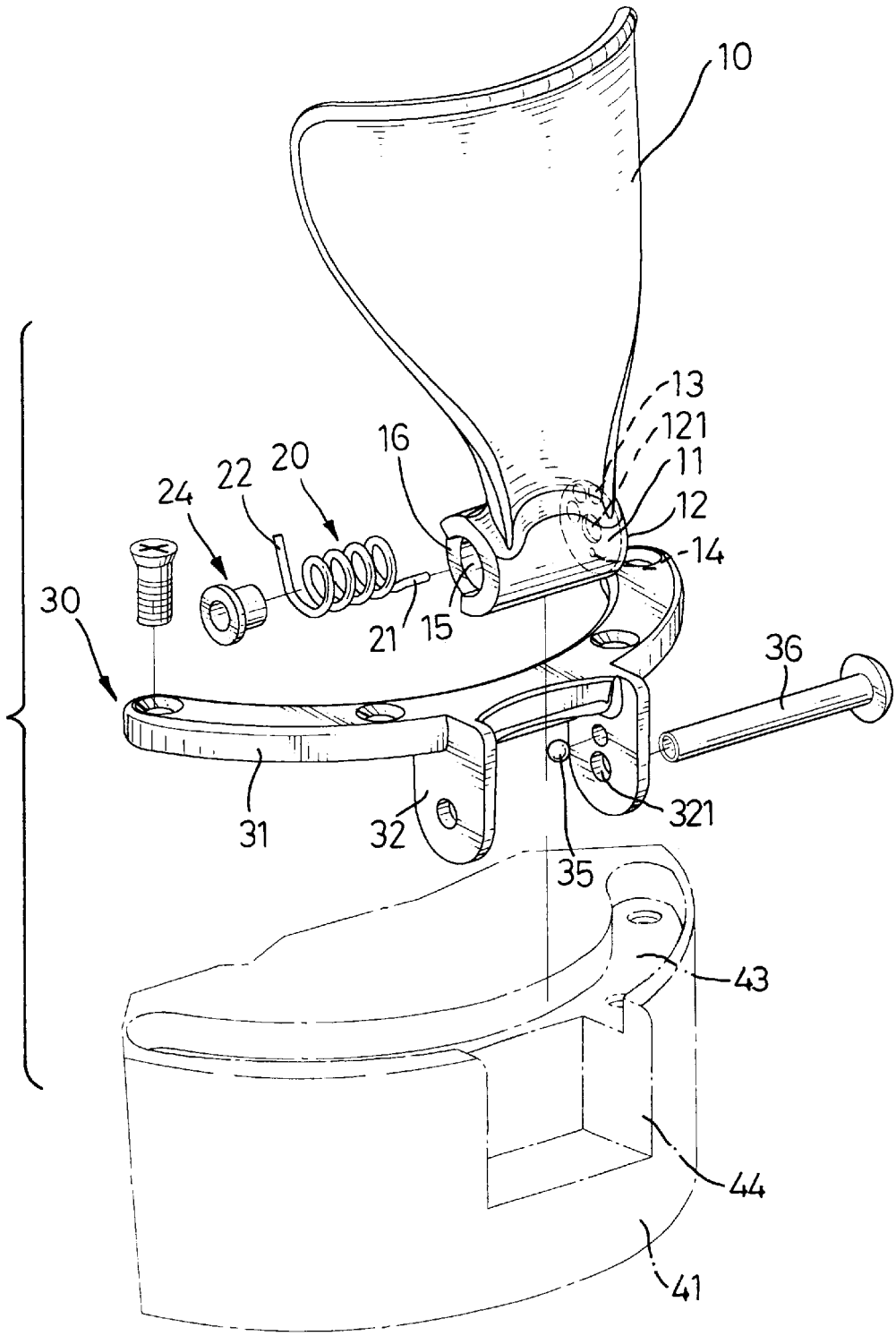
FIG. 2 is an exploded perspective view of the pivotal back in FIG. 1.
Figure 3:
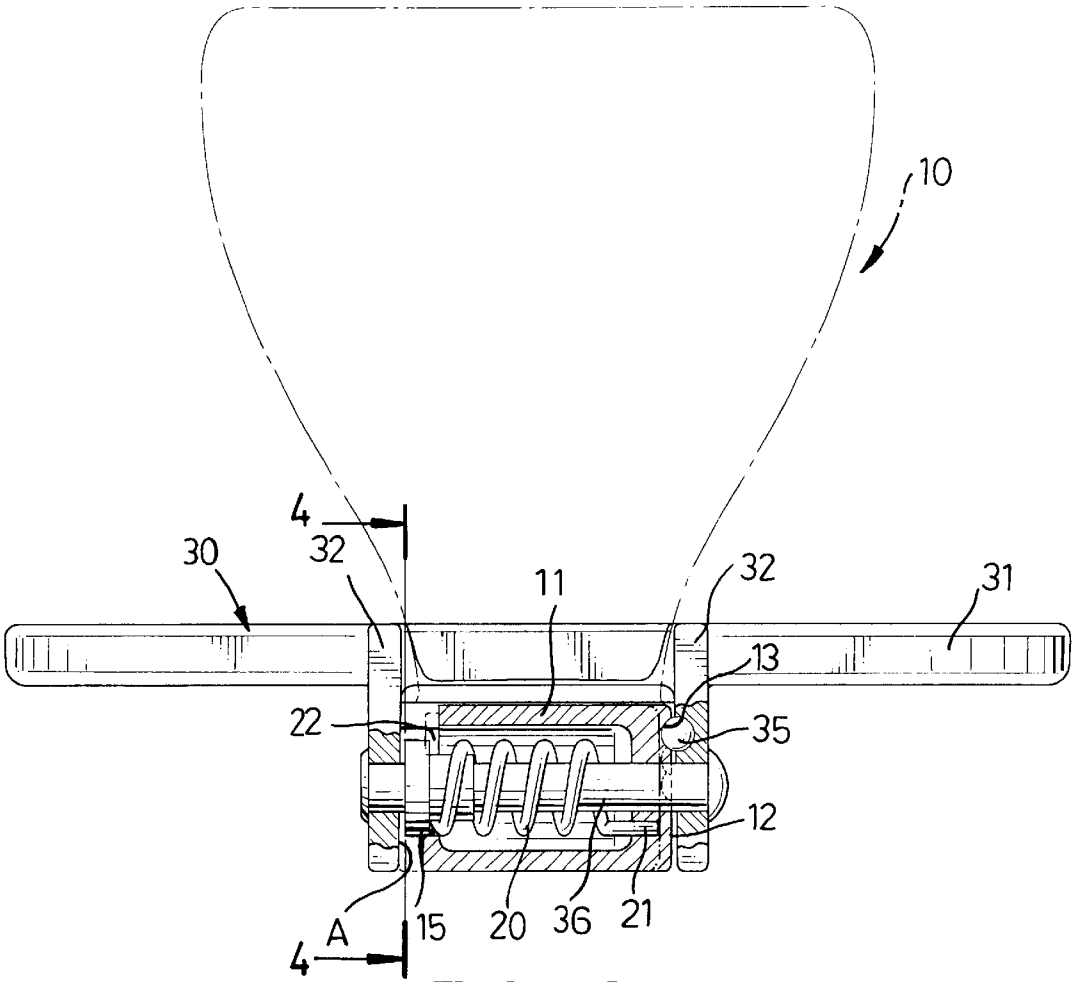
FIG. 3 is a front plan view in partial section of the pivotal back along line 3—3 in FIG. 1.
Figure 4:
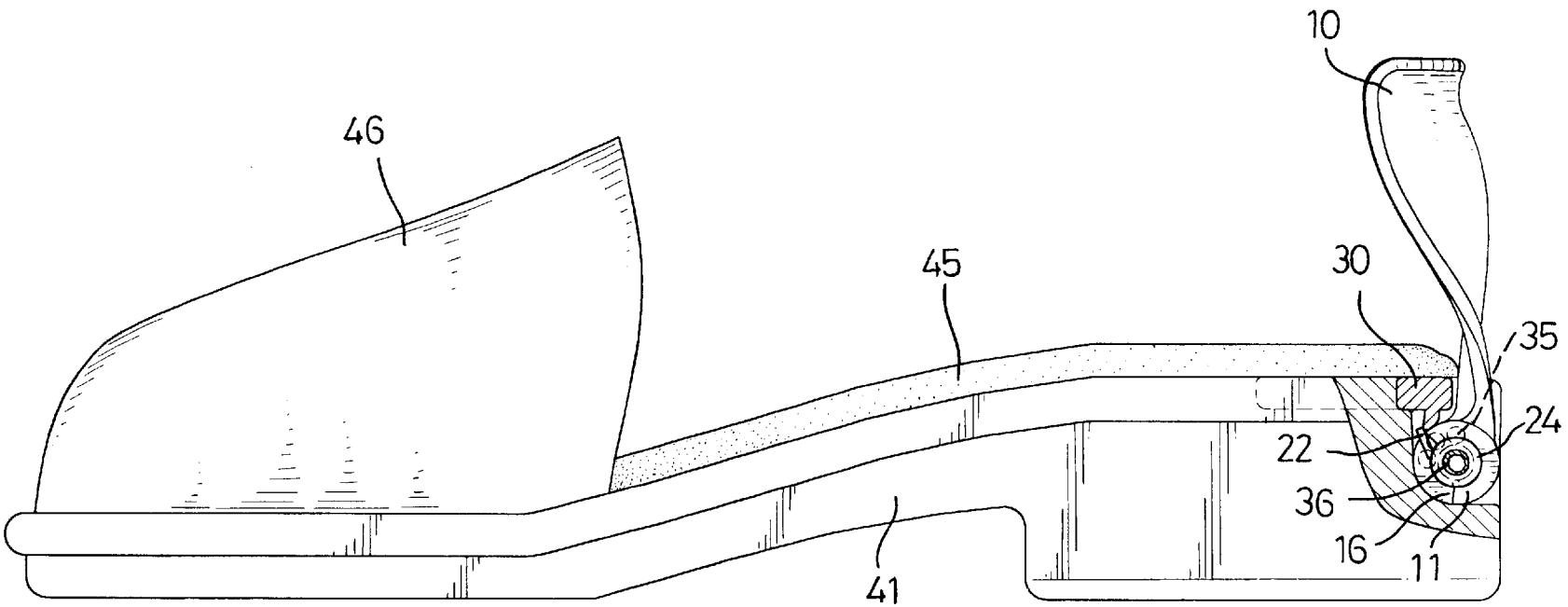
FIG. 4 is a side plan view in partial section of the pivotal back along line 4—4 in FIG. 3.

With reference to FIGS. 1 to 4, a pivotal back for a sandal style shoe comprises a back (10), a resilient pivot device and a hinge (30). The sandal style shoe has a sole (41), an insole (45) and a vamp (46) or straps (not shown) with a wearer's heel corresponding to the back (10). The pivotal back (10) is adapted to be attached to the sole (41) of the sandal style shoe with the hinge (30) embedded in the sole (41). A recess (not numbered) is formed in the sole (41) to mount the hinge (30) flush with the sole (41). The recess comprises a connecting bar recess (43) and a pivot device recess (44) to accommodate the hinge (30). The hinge (30) is secured inside the connecting bar recess (43) by multiple bolts (not numbered) and the wings (32) (not mentioned before) are accommodated inside the pivot device recess (44) of the sole (41).

The back (10) is curved to correspond to and protect the heel of a person wearing the sandal style shoe. The back (10) has a pivotal end (not numbered) to attach to the resilient pivot device and an upper end (not numbered).

The resilient pivot device comprises a pivot chamber (11) and a resilient element. The pivot chamber (11) is formed on the pivotal end of the back (10), and the resilient element is securely mounted inside the pivot chamber (11) to provide a restitution force to the back (10). The pivot chamber (11) is a cylindrical tube with a closed end (12) and an open end (15) with an edge (not numbered). A central hole (121) and an offset pin hole (14) are defined on the closed end (12). A notch (16) is defined in the edge of the open end (15). The resilient element mounted in the pivot chamber (11) is a coil spring (20) with a first end (21) and a second end (22). The first end (21) of the coil spring (20) is securely mounted in the offset pin hole (14). The second end (22) of the coil spring (20) is mounted in and presses against the notch (16) in the edge of the open end (15). Additionally, a plug (24) is mounted in the open end (15) and the coil spring (20) to prevent the coil spring (20) from coming out of the pivot chamber (11).

The hinge (30) comprises a U-shaped connecting bar (31) and two parallel wings (32). The wings (32) extend outward and downward from a middle portion of the U-shaped connecting bar (31). The wings (32) are separated by a distance to form a space between the two parallel wings (32). The pivot chamber (11) of the resilient pivot device is mounted in the space between the wings (32). The distance between the two parallel wings (32) is slightly larger than the pivotal chamber (11) so a small gap (A) is formed. A hole (321) is defined in each wing (32) to align with the central hole (121) of the closed end (12) of the pivot chamber (11). A pivot pin (36) passes through the holes (321) in the wings (32), the central hole (121) in the pivot chamber (11), the coil spring (20) and the plug (24) to rotatably and axially assemble all elements together.

Additionally, a positioning device is mounted between the closed end (12) of the pivot chamber (11) and the wing (32) adjacent to the closed end (12). The positioning device comprises a ball (35) rotatably mounted in an inner face of the wing (32) and multiple detents (13) defined in an outer face of the pivot chamber (11) and arranging in an arc to correspond to the ball (35). When the pivot chamber (11) rotates, the gap (A) allows the pivot chamber (11) to axially move and compress the coil spring (20) so the ball (35) moves out of one detent (13) and into another detent (13).

Figure 5:
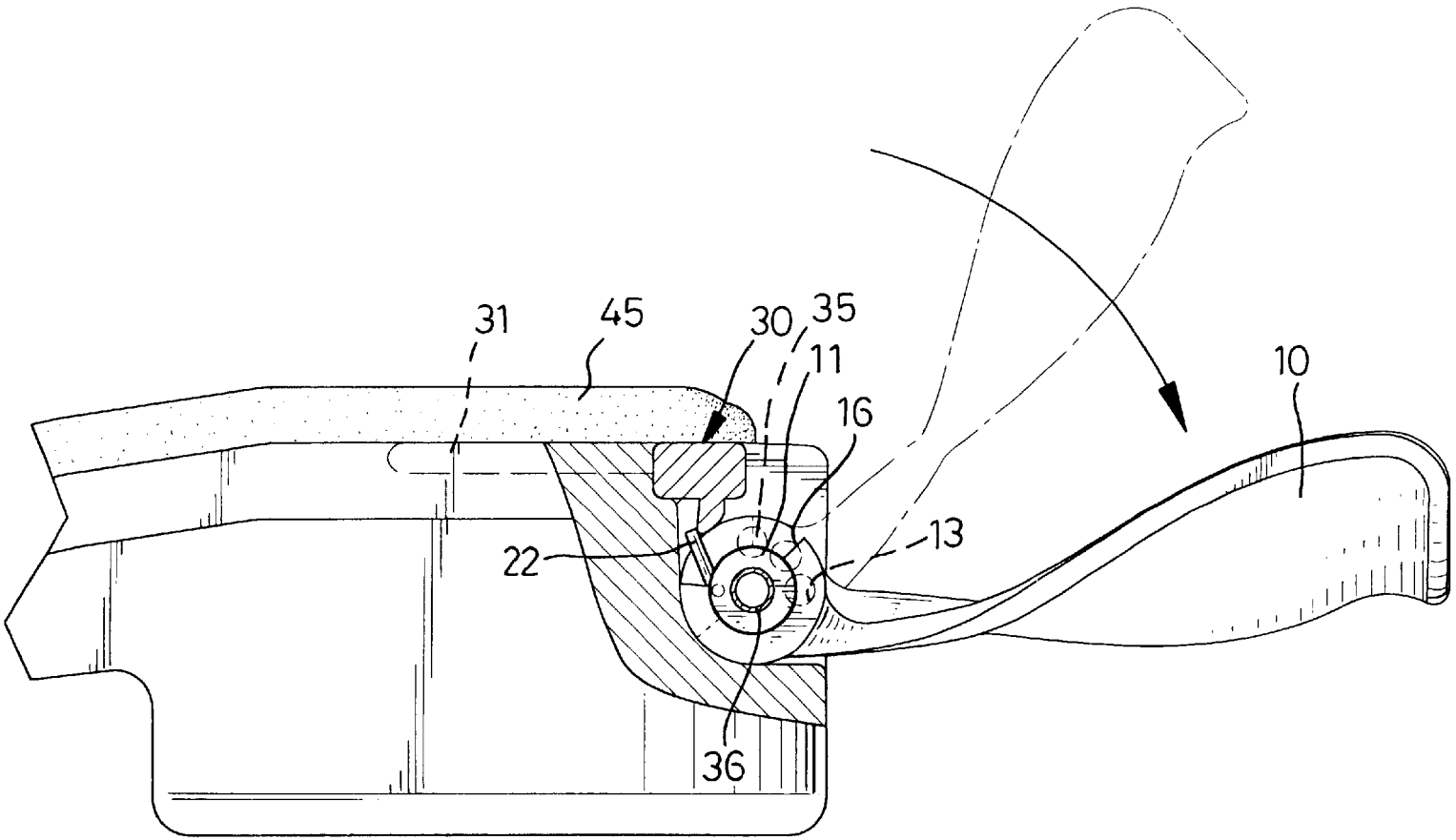
FIG. 5 is an operational side plan view in partial section of the pivotal back in FIG. 4.

Further with reference to FIG. 5, the second end (22) of the coil spring (20) extends through the notch (16) and is securely held under the U-shaped connecting bar (31) when the pivotal back is pivotally attached to the heel of the sole by the pivot pin (36). The second end (22) of the coil spring (20) is firmly secured and immovable. The first end (21) of the coil spring (20) rotates with the pivot chamber (11) thereby twisting the coil spring (20) and generating a restitution force to return the back (10) to its original upright position.

When a person wants to put on or take off the sandal style shoe, the back (10) is pivoted outward around the pivot pin (36) to enlarge the sandal style shoe interior. When person's foot is settled in the sandal style shoe, the back (10) is released and returns to its original upright position by the restitution force in the coil spring (20). To augment the restitution force of the coil spring (20), the ball (35) in a desired detent (13) keeps the back (10) from pivoting when the user walks.

Figure 6:
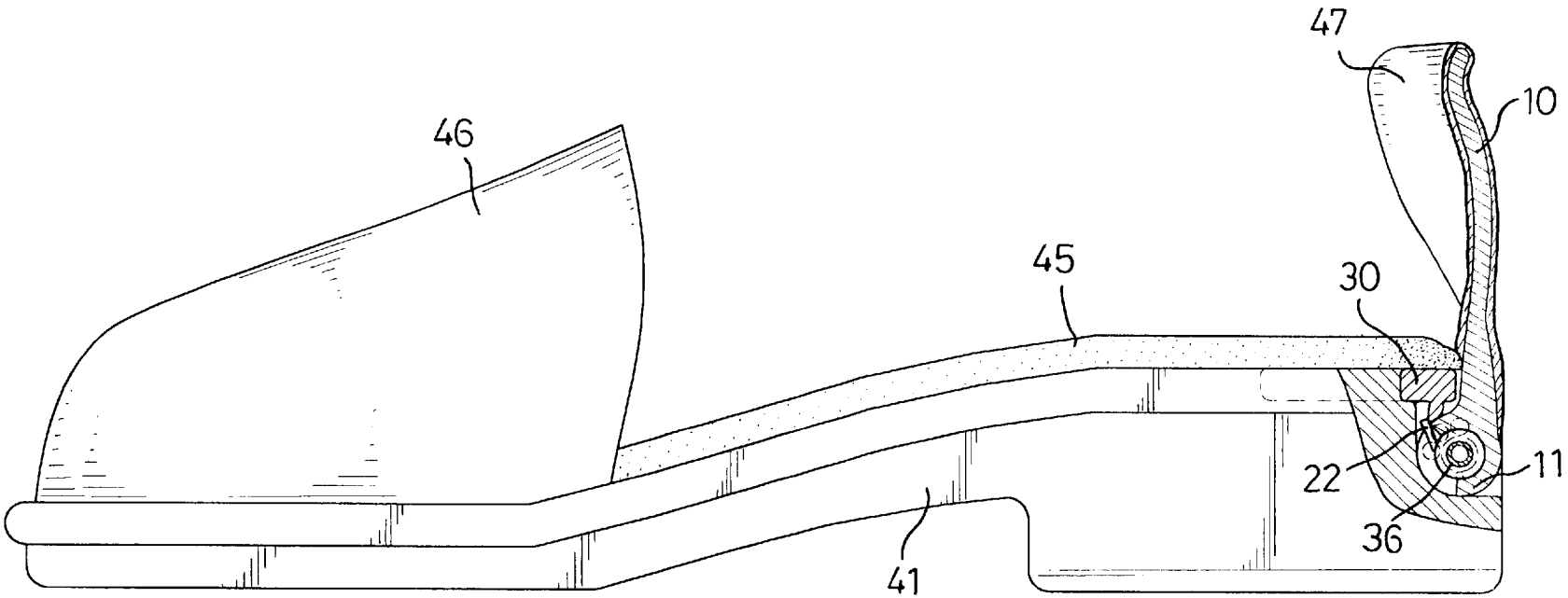
FIG. 6 is a cross-sectional side plan view of an embodiment of a pivotal back for a sandal style shoe in accordance with the present invention having a lining layer.

With reference to FIG. 6, an insole (45) is attached to the sole (41) and padding (47) is attached to the back (10) to make the sandal style shoe comfortable and have a good appearance.

The pivotal back for a sandal style shoe as described has the following advantages.

1. Because the back (10) is rotatable, a person simply pushes the back (10) backward to put on or take off the sandal style shoe. Therefore, the sandal style shoe having a pivotal back is convenient to use.
2. The resilient element and the positioning device provide the restitution force and the positioning force to the back (10) to keep the back resiliently from flopping or easily dropping from the foot.

Even though numerous advantages of the present invention have been set forth in the foregoing description, the disclosure is illustrative only. Changes may be made in detail within the principles of the invention to the full extent indicated by the broad general meaning of the terms in which the appended claims are expressed.

What is claimed is:

1. A pivotal back for a sandal style shoe adapted to mount on a sole (41), and the pivotal back comprising:

a back (10) having a pivotal end;

a pivot device attached to the back (10) and comprising a pivot chamber (11), which is a cylindrical tube, formed on the pivotal end of the back (10) and having a closed end (12), an open end (15) with an edge and a central hole (121) defined on the closed end (12); and a resilient element mounted inside the pivot chamber (11) to provide a restitution force to the back (10); and a hinge (30) adapted to attach to the sole (41) and comprising a U-shaped connecting bar (31);

two parallel wings (32) extending outward and downward from the U-shaped connecting bar (31), wherein a space is formed between the two parallel wings (32) to rotatably receive the pivot chamber (11) of the resilient pivot device and a hole (321) is defined in each wing (32) to align with the central hole (121) in the closed end (12); and a pivot pin (36) passing through the holes (321) of the wings (32), the central hole (121) in the closed end (12) of the pivot chamber (11) and the resilient element to rotatably and axially assemble all elements together.

2. The pivotal back as claimed in claim 1, wherein the resilient element is a coil spring (20) having a first end (21) and a second end (22);

an offset pin hole (14) is defined near the central hole (121) to firmly receive the first end (21) of the coil spring (20); and a notch (16) is defined at the edge around the open end (15) through which the second end (22) of the coil spring (20) extends;

wherein the second end (22) of the coil spring (20) is mounted under the U-shaped connecting bar (31), whereby, the second end (22) is firmly secured and immovable.

3. The pivotal back as claimed in claim 2, in which a positioning device is mounted between the closed end (12) of the pivot chamber (11) and the wing (32) adjacent to the closed end (12) to hold the back (10) in position, the positioning device comprising a ball (35) rotatably mounted on the wings (32); and multiple detents (13) defined in the closed end (12) and arranged in an arc to correspond to the ball (35);

wherein a distance between the two parallel wings (32) is slightly larger than the pivot chamber (11) to form a small gap (A), and the gap (A) allows the ball (35) to move from one detent (13) to another detent (13) when the pivot chamber (11) rotates.

4. The pivotal back as claimed in claim 3, in which a plug (24) fills the open end (15) of the pivot chamber (11) to prevent the coil spring (20) from escaping from the pivot chamber (11).

5. The pivotal back as claimed in claim 4, in which a padding (47) is attached to the back (10) to contact a foot.

6. The pivotal back as claimed in claim 2, in which a plug (24) fills the open end (15) of the pivot chamber (11) to prevent the coil spring (20) from escaping from the pivot chamber (11).

7. The pivotal back as claimed in claim 1, in which a positioning device is mounted between the closed end (12) of the pivot chamber (11) and the wing (32) adjacent to the closed end (12) to hold the back (10) in position, the positioning device comprising a ball (35) rotatably mounted on the wing (32); and multiple detents (13) defined in the closed end (12) of the pivot chamber (11) and arranged in an arc to correspond to the ball (35);

wherein a distance between the two parallel wings (32) is slightly larger than the pivot chamber (11) to form a small gap (A), and the gap (A) allows the ball (35) to move from one detent (13) to another detent (13) when the pivot chamber (11) rotates.

8. The pivotal back as claimed in claim 1, in which a plug (24) fills the open end (15) of the pivot chamber (11) to prevent the resilient element from escaping from the pivot chamber (11).

* * * * *